US010468761B2

(12) United States Patent
Imamura et al.

(10) Patent No.: US 10,468,761 B2
(45) Date of Patent: Nov. 5, 2019

(54) LOW-PROFILE ANTENNA DEVICE

(71) Applicant: HARADA INDUSTRY CO., LTD., Tokyo (JP)

(72) Inventors: Yutaka Imamura, Tokyo (JP); Jun Ishida, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 15/779,434

(22) PCT Filed: Nov. 28, 2016

(86) PCT No.: PCT/JP2016/085212
§ 371 (c)(1),
(2) Date: May 25, 2018

(87) PCT Pub. No.: WO2017/090771
PCT Pub. Date: Jun. 1, 2017

(65) Prior Publication Data

US 2018/0261913 A1 Sep. 13, 2018

(30) Foreign Application Priority Data

Nov. 27, 2015 (JP) ..... 2015-232177

(51) Int. Cl.
*H01Q 1/32* (2006.01)
*H01Q 9/40* (2006.01)
(Continued)

(52) U.S. Cl.
CPC ..... *H01Q 1/3275* (2013.01); *H01Q 1/362* (2013.01); *H01Q 5/335* (2015.01); *H01Q 9/40* (2013.01); *H01Q 1/1214* (2013.01); *H01Q 1/42* (2013.01)

(58) Field of Classification Search
CPC ..... H01Q 1/3275; H01Q 1/362; H01Q 5/335; H01Q 9/40
See application file for complete search history.

(56) References Cited

U.S. PATENT DOCUMENTS

2009/0207084 A1* 8/2009 Ikeda ..... H01Q 1/1207 343/713
2014/0203981 A1* 7/2014 Nakano ..... H01Q 1/521 343/749
2015/0200446 A1* 7/2015 Kaneko ..... H01Q 1/3275 343/702

FOREIGN PATENT DOCUMENTS

GB 2523443 A 8/2015
JP H09-205314 A 8/1997
(Continued)

OTHER PUBLICATIONS

International Search Report in PCT/JP2016/085212 dated Feb. 14, 2017.

*Primary Examiner* — Daniel Munoz
(74) *Attorney, Agent, or Firm* — Global IP Counselors, LLP

(57) ABSTRACT

A low-profile antenna device is provided for a vehicle. The low-profile antenna device includes a base plate, a circuit board, a base, a top-load element and a coil. The circuit board is disposed on the base plate, in parallel with the base plate. An amplifier circuit is placed on a front surface side of the circuit board, and a ground plate area having a ground plate and an empty area not having a ground plate are provided on a back, surface of the circuit board. The coil is disposed on the front surface side of the circuit board facing the empty area of the circuit board. The coil is disposed in a manner axially parallel with the circuit board, connected between the top-load element and the amplifier circuit, and adjusted to function as a resonance antenna.

10 Claims, 3 Drawing Sheets

(51) Int. Cl.

| | |
|---|---|
| ***H01Q 5/335*** | (2015.01) |
| ***H01Q 1/36*** | (2006.01) |
| *H01Q 1/42* | (2006.01) |
| *H01Q 1/12* | (2006.01) |

(56) References Cited

FOREIGN PATENT DOCUMENTS

| | | | |
|---|---|---|---|
| JP | 2001-185937 | A | 7/2001 |
| JP | 2015-133692 | A | 7/2015 |
| WO | 2008062746 | A1 | 5/2008 |

* cited by examiner

LOW-PROFILE ANTENNA DEVICE

CROSS-REFERENCE TO RELATED APPLICATIONS

This application is a U.S. National stage application of International Application No. PCT/JP2016/08521, filed Nov. 28, 2016, which claims priority to Japanese Patent Application No 2015-232177 filed on Nov. 27, 2015.

BACKGROUND

Technical Field

The present invention relates to a low-profile antenna device, and more particularly to a low-profile antenna device for a vehicle.

Background Information

At present, a variety of antenna devices are mounted on a vehicle. Such antenna devices include, for example, an AM/FM radio antenna that can receive an AM broadcast and an FM broadcast. A rod antenna is generally used for an AM/FM radio antenna. The rod antenna is configured with an element section in which an element is formed h a conductor having a spiral shape (helical element) covered with a cover, and a base plate on which the element section is attached.

When the rod antenna is attached to a vehicle body, a large part of the element section protrudes from the vehicle body, which may spoil the appearance and design of the vehicle body, and the element section may be damaged at the time of garaging, or washing the vehicle. The element section, which is exposed to the outside of the vehicle, may also be stolen.

To cope with the above problem, there has been proposed a low-profile antenna device whose height is made lower than that of a rod antenna, the element of which is housed in an antenna case so as to be protected from exposure to the outside of a vehicle, and the antenna case of which is configured to have a fukahire shape (shark fin shape) in consideration of the design of the entire vehicle carrying an antenna. Many of such low-profile antenna devices have a height lower than or equal to 70 mm and a longitudinal length of around 200 mm, in consideration of laws and regulations and the like.

However, such an antenna device has a problem that, due to an influence from a conductor loss of an antenna (a shortened element length) caused by a low-profile of 70 mm or less, radiation efficiency tends to be lowered, which causes sensitivity deterioration. For example, Japanese Patent Application Kokai Publication No. 2012-204996(Patent Document 1) discloses a low-profile antenna device, in which a coil is inserted between a top-load element and an amplifier circuit for the purpose of eliminating sensitivity deterioration. In Patent Document 1, the top-load element is disposed on an element holder that is provided to stand on a circuit board, and a coil is disposed on the element holder. Since performance degradation of the coil causes lowering in an antenna gain, a holding section is provided on the element holder in order to dispose the coil around the middle between the top-load element and the circuit board, so that a conductor that lowers a Q value of the coil is not present around the coil. A predetermined feeding terminal is used or complicated forming is required for connection between the board and the coil.

SUMMARY

However, in Patent Document 1, in order to dispose the coil around the middle between the top-load element and the circuit board, the holding section needs to be additionally provided on the element holder. For connection between the board and the coil, a predetermined feeding, terminal needs to be used or complicated forming is required. For this reason, the cost is increased, and the number of components is also large.

An object of the present invention, therefore, is to overcome the problems existing in the prior art, and to provide a low-profile antenna device that can be manufactured at a low cost by reducing the number of structural components, the number of assembly steps, and the like without lowering antenna performance.

To achieve the above object of the present invention, a low-profile antenna device according to the present invention may include a base plate fixed to a vehicle; a circuit board disposed on the base plate in parallel with the base plate, the circuit board provided with an amplifier circuit placed thereon and having a ground plate area with a ground plate and an empty area with no ground plate; a top-load element, that is spaced apart by a gap in a height direction from the base plate, and functions as a capacity antenna; and a coil disposed on a surface facing the empty area of the circuit board or in the empty area, the coil being disposed axially, parallel with the circuit board, being connected between the top-load element and the amplifier circuit on the circuit board, and being adjusted to function as a resonance antenna at a desired center frequency by a series circuit of the top-load element and the coil.

The top-load element may he connected to the coil by using a belt-like connection line.

The belt-like connection line may extend from a front side of the top-load element.

The belt-like connection line may have a shape tapered toward the coil.

The belt-like connection line may be formed of the same member as that of the top-load clement.

The top-load element may include a planar body having a surface extending in parallel with the base plate.

The top-load element may have a planar slope section between the planar body having a surface extending in parallel with the base plate and the belt-like connection line.

The top-load element may have an apex section and side sections inclined from both sides of the apex section, which is formed into a mountain-shape in cross section.

The amplifier circuit of the circuit board may include a plurality of frequency-band-specific amplifier circuits provided in accordance with multiple frequency bands, and the coil may include a plurality of frequency-band-specific coils provided in accordance with multiple frequency bands. The low-profile antenna device may further include switches respectively provided between the plurality of frequency-band-specific amplifier circuits and the plurality of frequency-band-specific coils, which are ON/OFF controlled in accordance with a frequency band to be received.

The amplifier circuit of the circuit board may include a plurality of frequency-band-specific amplifier circuits provided in accordance with multiple frequency bands, and the coil may be connected to one of the plurality of frequency-band-specific amplifier circuits corresponding to a frequency band to be received. The low-profile antenna device may further include a capacitor connected between the top-load element and the other of the plurality of frequency-band-specific amplifier circuits corresponding to a frequency band to be received that is different from that on the coil side, the capacitor being adjusted to function as a resonance antenna at a desired center frequency different from that on the coil side by a series circuit of the top-load element and the capacitor.

The low-profile antenna device according to the present invention has such advantages that it can be manufactured at a low cost by reducing the number of structural components, the number of assembly steps, and the like without lowering antenna performance.

BRIEF DESCRIPTION OF TRE DRAWINGS

Referring now to the drawings, examples of a low-profile antenna device are illustrated.

FIG. 1 is a schematic partial cross-sectional side view for explaining a low-profile antenna device according to the present invention.

FIG. 2(*a*) and FIG. 2(*b*) are schematic diagrams for explaining a circuit board used for the low-profile antenna device according to the present invention.

Figure 5A:
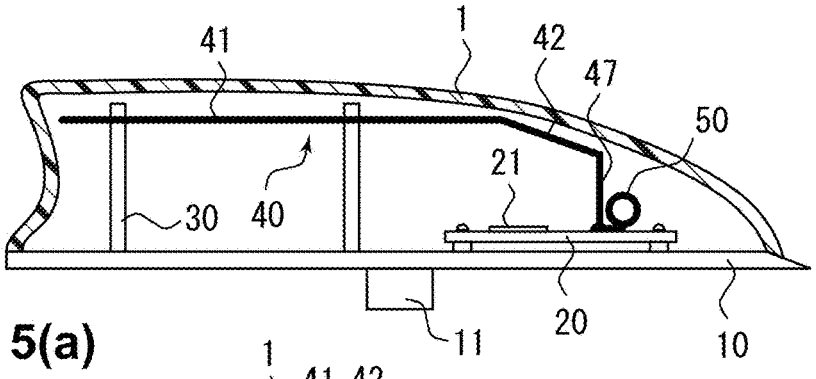
Figure 5B:
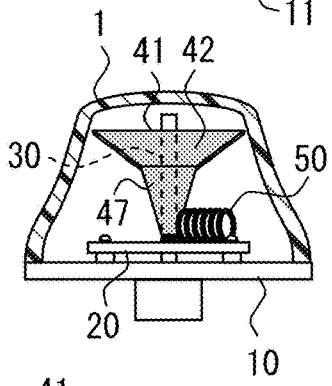
Figure 5C:
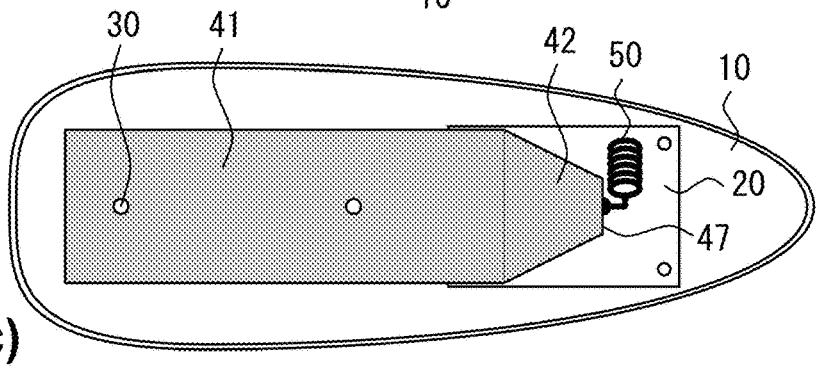

FIG. 5(*a*), FIG. 5(*b*) and FIG. 5(*c*) are schematic partial cross-sectional diagrams, for explaining the low-profile antenna device according to the present invention.

Figure 6A:
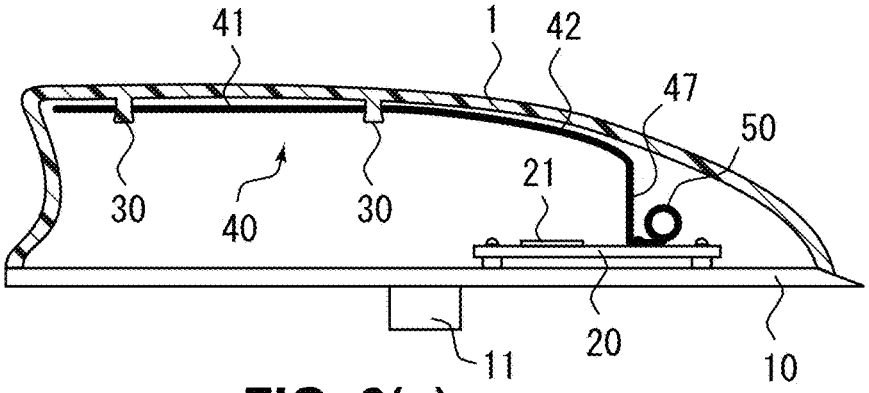
Figure 6B:
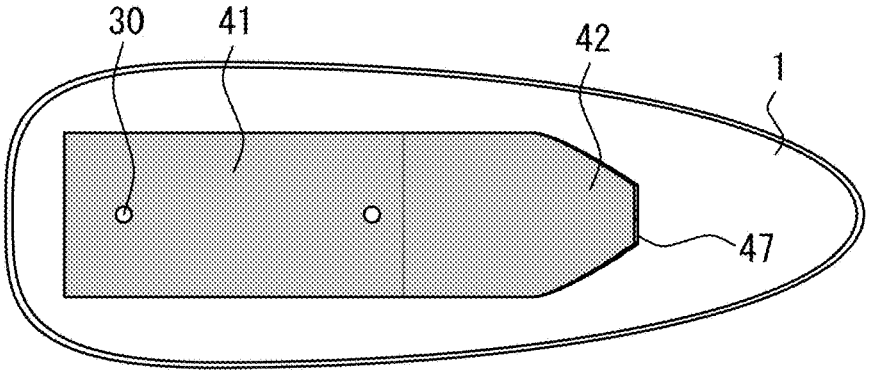

FIG. 6(*a*) and FIG. 6(*b*) are schematic partial cross-sectional diagrams for explaining another holding method of a top-load element of the low-profile antenna device according to the present invention.

Figure 7:
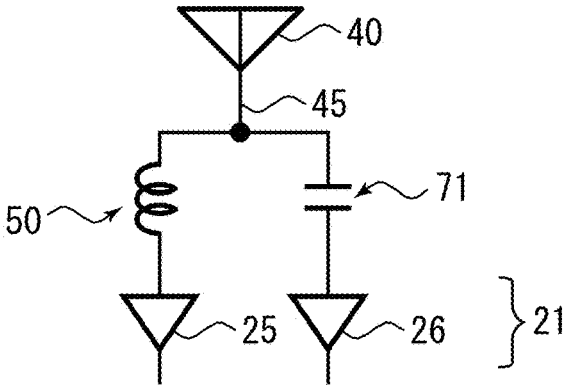

FIG. 7 is an equivalent circuit diagram for explaining an example where a capacitor is used for the low-profile-antenna device according to the present invention.

DETAILED DESCRIPTION OF THE EMBODIMENTS

Figure 1:
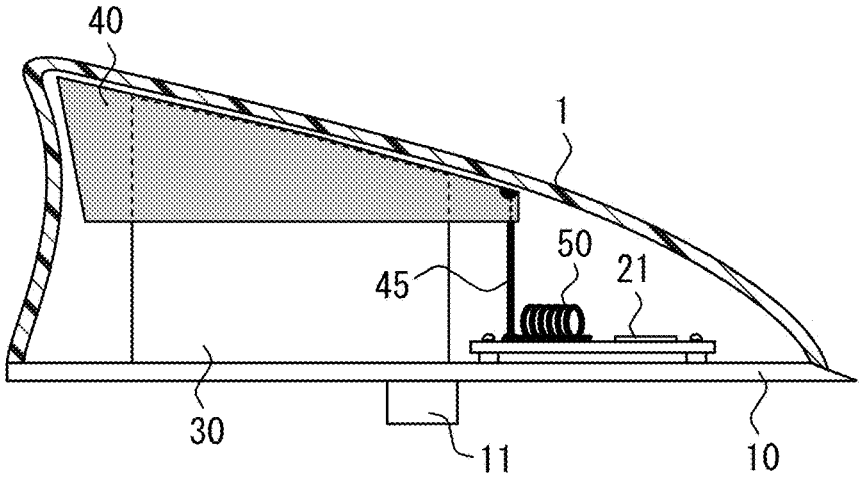

Hereinafter, an embodiment for practicing the present invention will be described with reference to the accompanying drawings. FIG. 1 is a schematic partial cross-sectional side view for explaining a low-profile antenna device according to the present invention. As illustrated, the low-profile antenna device according to the present invention is mainly configured with a base plate 10, a circuit board 20, a base 30, a top-load element 40, and a coil 50. The low-profile antenna device according to the present invention may be configured as a composite antenna that can receive signals in, for example, both an FM frequency band and an AM frequency band.

The base plate 10 is fixed to a vehicle. Specifically, the base plate 10 may be what is called a resin base formed of an insulator of resin, or the like, or may be what is called a metal base formed of a conductor such as metal. The base plate 10 may also he a composite base of resin and metal. For example, a screw boss 11 is provided on the base plate 10. The screw boss 11 is inserted through a hole provided on a roof or the like of a vehicle, and the base plate 10 is fixed by using a nut in the inside of the vehicle in such a manner that the roof or the like is sandwiched between the nut and the base plate 10. A cable and the like that connect the inside of the vehicle and the antenna device are inserted through the screw boss 11. The base plate 10 is configured so as to be covered by an antenna cover 1. The antenna cover 1 has an internal space for housing an element, a circuit, and the like, and defines an outer shape of the low-profile antenna device.

Figure 2A:
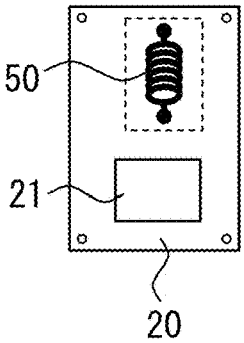
Figure 2B:
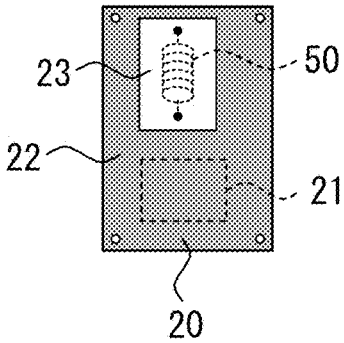

The circuit board 20 is disposed on the base plate 10 in parallel with the base plate 10. FIGS. 2(*a*) and 2(*b*) show the circuit board used in the low-profile antenna device according to the present invention. FIGS. 2(*a*) and 2(*b*) are schematic diagrams for explaining the circuit board used for the low-profile antenna device according to the present invention, in which FIG. 2(*a*) is a top view, and FIG. 2(*b*) is, a bottom view. In the drawings, the same reference numerals as those in FIG. 1 denote the same parts as those in FIG. 1. As illustrated, an amplifier circuit 21 is placed on the circuit board 20. The, amplifier circuit 21 is used for amplifying a received signal. For example, when the low-profile antenna device according to the present invention is configured as a composite antenna that can receive signals in both an FM frequency band and an AM frequency band, frequency-band-specific amplifier circuits provided in accordance with multiple frequency bands, that is, an FM frequency band and an AM frequency band, may be included as the amplifier circuit 21. The amplifier circuit 21 is placed on a front surface side of the circuit board 20. In the present description, the base plate 10 side is referred to as a back surface side, and a surface opposed to the base plate 10 side is referred to as the front surface side. As shown in FIG. 2(*b*), the circuit board 20 of the present invention has a ground plate area and an empty area 23 on the back surface side. The ground plate area 22 is an area having what is called a ground plate and functions as a ground of the circuit board by providing a planar metal thin film, such as a copper foil, on a substrate. The empty area 23 is an area not having a ground plate. That is, it is an area where a metal thin film is removed by etching.

Referring back to FIG. 1, the base 30 is disposed vertically to the base plate 10. The top-load element 40 is disposed on the base 30. The base 30 may he formed by an insulating resin. The base 30 may hold the top-load element 40 at a predetermined height.

The top-load element 40 is what is called a capacity-loaded antenna element. For example, in an AM frequency band, the top-load element 40 functions as a capacity antenna. In the illustrated example, the top-load element 40 has an apex section and side sections inclined from both sides of the apex section, which is formed into a mountain-shape in cross section. The top-load element 40 is so shaped as to match with the shape of a top section of the antenna cover 1. However, the present invention is not particularly limited to the shape of the illustrated example, and the top-load element 40 may have any other shape that functions as a capacity-loaded antenna element.

The coil 50 is connected between the top-load element 40 and the amplifier circuit 21 on the circuit board 20. The coil 50 is used together with the top-load element 40 for tuning to a desired target frequency and an inductor thereof can be selected as the coil 50 so that the antenna device functions as a resonance antenna in, for example, an FM frequency band. That is, the coil 50 may be adjusted to function as a resonance antenna at a center frequency of, for example, an FM frequency band by a series circuit of the top-load element 40 and the coil 50. The series circuit of the top-load element 40 and the coil is adjusted to be for a desired target frequency with being unconnected to the amplifier circuit 21 (as a passive antenna). The coil 50 is disposed on the front surface side of the circuit board 20 facing the empty area 23 of the circuit board 20. That is, the coil 50 is disposed at a position corresponding to the empty area 23 isolated from the metal thin film of the circuit board 20. In this manner, performance degradation of the coil 50 is prevented. The coil 50 is axially parallel with the circuit board 20. That is, the coil 50 does not need to stand vertically to the circuit board 20, and is disposed in a direction in which the coil 50 can easily be placed. In the illustrated example, the coil 50 is disposed axially parallel with a longitudinal direction of the low-profile antenna device. However, the present invention is not limited to this, and the coil 50 may be disposed in parallel with a short side direction or in an oblique direction so as to be disposed in parallel with the circuit board 20.

In the illustrated example, the coil 50 is connected to a front side of the top-load element 40 by using a connection line 45. The front side of the top-load element 40 denotes a lower height side of one of both ends in a longitudinal direction of the top section of the top-load clement 40. The connection line 45 may be, for example, a conducting wire. Further, the connection line 45 may be a conducting wire having a large diameter in order to reduce a conductor loss. In this manner, antenna performance can be improved. In the above example, the coil 50 is not overlapped by the top-load element and is disposed on the front side of the top-load element. However, the present invention is not limited to this, and the coil 50 may be disposed below the top-load element 40. That is, the coil 50 may he disposed at a location covered by the top-load element 40.

The coil 50 can be a spirally-wound conducting wire which is to be mounted on the circuit board by soldering. Alternatively, the coil 50 may be surface-mounted on the circuit board 20 by, for example, a chip mounter. The illustrated example shows the coil 50 as one coil. However, the present invention is not limited to this, and the coil 50 may be a coil group obtained by connecting a plurality of coils in series or in parallel.

In the above arrangement, a sufficient distance is obtained between the coil 50 and the top-load element 40. Accordingly, performance degradation of the coil 50 due to the top-load element 40 can be minimized. In this manner, antenna performance can be improved. Specifically, as compared to a configuration where a coil is disposed at an intermediate position between a top-load element and a circuit board, reception sensitivity (a gain) in an FM frequency band was improved by around 1 dB. Since performance degradation of the coil 50 no longer needs to be considered, size of the top-load element 40 can be maximized in the antenna cover 1, and a capacity component can be increased even more. Further, since the coil 50 is disposed at a position corresponding to the empty area 23 of the circuit board 20, performance degradation of the coil 50 due to the circuit board 20 can be minimized. Since the coil 50 can be provided away from the top-load element 40, the top-load element 40 can be provided at a lower position. That is, an antenna device of a lower profile can be obtained. The number of structural components, such as a holding section, of the coil 50 can be reduced and the number of assembly steps can also be reduced. Accordingly, the low-profile antenna device according to the present invention can be manufactured at a low cost.

Performance deterioration of the coil 50 due to the base plate 10 can be restricted further by disposing the coil 50 at a position away from a conductor such as metal. Specifically, when the base plate 10 is a metal base, a notch section may be provided in such a way as to correspond to a position on the base plate 10 at which the coil 50 is disposed, to form an empty area. When the base plate 10 is a resin base or a composite base, the coil 50 may be disposed so as to correspond to the position of an insulator. In contrast to the illustrated example, the configuration may be such that the amplifier circuit 21 is placed on the circuit board 20 on a side closer to the base plate 10, and the ground plate area 22 and the empty area 23 are disposed on a surface facing the base plate 10. In this case, the coil 50 can be placed in the empty area 23. That is, the coil 50 may be disposed on a surface facing the empty area 23 of the circuit board 20, or may be disposed within the empty area 23.

Figure 3:
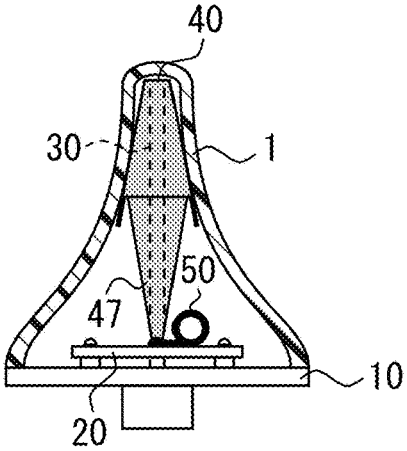
FIG. 3 is a schematic partial cross-sectional front view for explaining a connection line of the low-profile antenna device according to the present invention.

FIG. 3 shows a schematic front view for explaining the connection line of the low-profile antenna device according to the present invention. In the drawing, the same reference numerals as those in FIG. 1 denote the same parts as those in FIG. 1. In the illustrated example, a belt-like connection line 47 is used to connect the top-load element 40 and the coil 50. Specifically, in the illustrated example, the belt-like connection line 47 extends from the front side of the top-load element, and is disposed in a direction in which a belt-like surface can be seen from the front. However, the present invention is not limited to this, and the belt-like connection line 47 may be disposed in a direction in which the belt-like surface is seen from the side. That is, the belt-like connection line 47 may be disposed by being twisted by 90 degrees.

In the illustrated example, the belt-like connection line 47 is tapered toward the coil 50. In this manner, a broad band can be achieved, especially in an FM frequency band. However, the present invention is not limited to this and, for example, square connection line may be employed depending on a reception sensitivity condition and the like.

The belt-like connection line 47 may be configured by the same member as the top-load element 40. That is, the belt-like connection line 47 may be manufactured in such a manner that, for example, sheet metal is punched to integrally form the top-load element 40 and the belt-like connection line 47, and pressed so that the belt-like connection line 47 extending from the top-load element 40 is obtained. In this manner, the belt-like connection line 47 is formed integrally and, in turn, the number of assembly steps and the like can be reduced.

Figure 4:
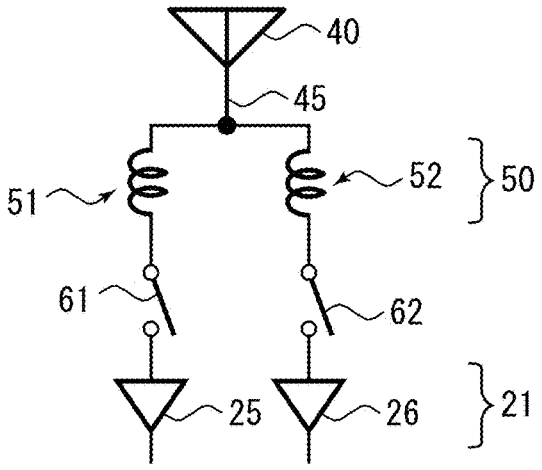
FIG. 4 is an equivalent circuit diagram for explaining, an example where a switch is attached to the low-profile antenna device according to the present invention.

Next, an explanation will be given of further improvement in performance when the low-profile antenna device according to the present invention is configured as a composite antenna device that can receive signals in multiple frequency bands. Along with reduction in the size of the low-profile antenna device, isolation between antenna elements may become a problem in the composite antenna supporting multiple frequency bands. In view of the above, an explanation will be made on the low-profile antenna device with improved isolation with reference to FIG. 4. FIG. 4 is an equivalent circuit diagram for explaining an example where a switch is attached to the low-profile antenna device according to the present invention. In the drawing, the same reference numerals as those in FIG. 1 denote the same parts as those in FIG. 1. In this example, the low-profile antenna device supports, for example, an FM frequency band, an AM frequency band, and Band-III of digital audio broadcasting (DAB (Digital Audio Broadcasting)).

In the illustrated example, the coil 50 connected to the top-load element 40 includes a plurality of frequency-band-specific coils provided in accordance with multiple frequency bands, that is, a first coil 51 and a second coil 52. The amplifier circuit 21 includes a plurality of frequency-band-specific amplifier circuits provided in accordance with multiple frequency bands, that is, a first amplifier circuit 25 and a second amplifier circuit 26. The first coil 51 functions as part of an element for, for example, an FM frequency band. The second coil 52 functions as part of an element for, for example, Band-III of DAB. The top-load element 40 functions as part of an element for an FM frequency band and a frequency band of Band-III, and also functions as an element for, for example, an AM frequency band. The top-load element 40 is connected to end sections of the first coil 51 and the second coil 52 on an opposite side of end sections connected respectively to the first amplifier circuit 25 and the second amplifier circuit 26. The top-load element 40 functions as a capacity-loaded antenna like in the above example. By obtaining capacitance with the top-load element 40, an element for an FM frequency band and an element for DAB are shortened.

That is, the composite antenna device of the present invention has a configuration, in which the top-load element 40 is used in common for the element for the FM frequency band and the element for DAB, the top-load element 40 is connected to the first coil 51 and the second coil 52 in parallel, and the first coil 51 and the second coil 52 are connected to the first amplifier circuit 25 and the second amplifier circuit 26, respectively. In this case as well, the first coil 51 and the second coil 52 may be disposed on a surface facing the empty area 23 on the circuit hoard 20 and each of the coils may be disposed axially parallel with the circuit board 20.

In the example shown in FIG. 4, switches are respectively provided between the coils and the amplifiers so as to block a frequency band other than a selected frequency band. In this manner, performance of the selected frequency band is improved. As illustrated, a first switch 61 is provided between the first coil 51 and the first amplifier circuit 25. A second switch 62 is provided between the second coil 52 and the second amplifier circuit 26. The first switch 61 and the second switch 62 are ON/OFF controlled. That is, when the first switch 61 is ON, the second switch 62 is controlled to be OFF. When the first switch 61 is OFF, the second switch 62 is controlled to be ON. That is, the switches 61 and 62 are ON/OFF controlled in accordance with a frequency band to be received. In this manner, isolation between antenna elements is improved. In the illustrated example, the switch is used for ON/OFF control; instead, a filter circuit or the like may be employed in place of the switch, so long as isolation between antenna elements can be improved.

In the illustrated example, the composite antenna device which is formed for FM, AM, and DAB (Band-III) is explained. However, the present invention is not limited to this. For example, the antenna device may be configured to be able to receive a signal in L-Band of DAB, or signals in other frequency bands, such as a frequency band of V-Low. In this case as well, by providing a switch, a filter circuit, and the like in an appropriate way, isolation between antenna elements can be improved.

When a plurality of switches are configured to be able to be ON simultaneously, a filter circuit may be provided between a tuning coil section and the switch as needed to improve isolation between antenna elements.

Next, an explanation will be given of another example of the low-profile antenna device according to the present invention with reference to FIGS. 5(*a*), 5(*b*) and 5(*c*). FIGS. 5(*a*), 5(*b*) and 5(*c*) are schematic partial cross-sectional diagrams for explaining the low-profile antenna device according to the present invention, in which FIG. 5(*a*) is a side view, FIG. 5(*b*) is a front view, and FIG. 5(*c*) is a plan view. In the drawing, the same reference numerals as those in FIGS. 1 and 3 denote the same parts as those in FIGS. 1 and 3. In the illustrated example described above, the top-load element 40 has an apex section and side, sections inclined from both sides of the apex section, which is formed into a mountain-shape in cross section. In contrast, in the example shown in FIGS. 5(*a*), 5(*b*) and 5(*c*), the top-load element 40 includes a planar body 41 having a surface extending in parallel with the base plate 10. As illustrated in the example, the planar body 41 includes a plate member having a rectangular shape. The planar body 41 is held by the base 30. As shown in FIG. 5(*b*), the belt-like connection line 47 has a shape which is tapered toward the coil 50. The belt-like connection line 47 may be, for example, a square connection line depending on a reception sensitivity condition and the like. As illustrated in the example, the coil 50 is disposed in a direction axially orthogonal to a longitudinal direction of the low-profile antenna device, that is, parallel with a short side direction of the low-profile antenna device. The coil 50 may also be disposed axially parallel with the longitudinal direction.

In the illustrated example, the top-load element 40 is inclined along a lower front end section of the antenna cover 1. In the illustrated example, the top-load element 40 includes a planar slop section 42 between the planar body 41 having a surface extending in parallel with the base plate 10 and the belt-like connection line 47. By the above configuration, a lower section of the front end side of the antenna cover 1 can be used effectively. The planar slope section 42 may have the same width as a width in a short side direction of the planar body 41, or may have a shape that is tapered toward the belt-like connection line 47 as shown in the illustrated example. The planar body 41 and the planer slope section 42 are illustrated as a flat surface. However, the present invention is not limited to this, and the planar body 41 and the planar slope section 42 may be configured to have, for example, a curved surface along a ridgeline of the antenna cover 1. In the illustrated example, the planar body 41, the planar slope section 42, and the belt-like connection line 47 constituting the top-load element 40 are configured by one same member. These parts are not limited to one same member and may also be configured as separate bodies. The present invention is by no means limited to the illustrated example, and the belt-like connection line 47 may extend in an orthogonal direction directly from the planar body 41 without providing the planar slope section.

As shown in the illustrated example, in the low-profile antenna device according to the present invention, the top-load element 40 is configured as, the flat planar body 41 by being lowered to the base plate 10 side, so that a lower side of the antenna cover 1 can be well used and the top-load element 40 can be an element having a wide surface area. That is, a larger capacity can be obtained. However, a small distance from the base plate 10 and a conductive section of a vehicle may cause degradation of antenna performance. In particular, the top-load element 40 provided close to the periphery of the amplifier circuit 21 of the circuit board 20 and the coil 50 may cause performance degradation. For this reason, in the illustrated example, while the planar body 41 has a wide area, the planar slope section 42 and the belt-like connection line 47 have a tapered shape, so that an area facing the circuit board 20 and the like is reduced to lower capacitive coupling, and degradation of antenna performance is minimized. In this manner, a top section of the low-profile antenna device can be made even lower.

In the example of FIGS. 5(*a*), 5(*b*) and 5(*c*), the planar body 41 of the top-load element 40 is held by the base 30 provided on the base plate 10. However, the present invention is not limited to this, and the base may be provided on the antenna cover side. FIGS. 6(*a*) and 6(*b*) show schematic partial cross-sectional diagrams for explaining the low-profile antenna device according to the present invention, in which FIG. 6(*a*) is a side view and FIG. 6(*b*) is a back surface diagram of the antenna cover. In the drawing, the same reference numerals as those in FIGS. 5(*a*), 5(*b*) and 5(*c*) denote the same parts as those in FIGS. 5(*a*), 5(*b*) and 5(*c*). In the illustrated example, the base 30 is provided on the antenna cover 1. Specifically, the base 30 can be formed integrally with the antenna cover 1 and the top-load element 40 can be fixed to the base 30 that passes through a hole provided on the top-load element 40. When the top-load, element 40 is fixed to the antenna cover 1 side in the above manner and the antenna cover 1 is fitted to the base plate 10, the belt-like connection line 47 may be configured to be connected to the circuit board 20. In the illustrated example, the planar slope section 42 has a curved surface along a ridgeline of the antenna cover 1. Alternatively, the planar slope section 42 may have a flat surface as shown in FIGS. 5(*a*), 5(*b*) and 5(*c*).

Next, an explanation will be given of another example of the low-profile antenna device according to the present invention with reference to FIG. 7. FIG. 7 is an equivalent circuit diagram for explaining an example where a capacitor is used for the low-profile antenna device according to the present invention. In the drawing, the same reference numerals as those in FIGS. 1 and 4 denote the same parts as those in FIGS. 1 and 4. In this example, a low-profile antenna device supports, for example, an FM frequency band, an AM frequency band, and a frequency band of digital television broadcasting (DTV (Digital Television Broadcasting)).

In the illustrated example, the amplifier circuit 21 is constituted by a plurality of frequency-band-specific amplifier circuits provided in accordance with multiple frequency bands, that is, the first amplifier circuit 25 and the second amplifier circuit 26. The coil 50 connected to the top-load element 40 is connected to a frequency-band-specific amplifier circuit corresponding to a frequency band to be received, that is, the first amplifier circuit 25. A capacitor 71 is connected between the top-load element 40 and a frequency-band-specific amplifier circuit corresponding to a frequency band to be received that is different from that on the coil 50 side, that is, the second amplifier circuit 26. The coil 50 functions as part of an element for, for example, an FM frequency band. The capacitor 71 functions as part of an element for, for example, a DTV frequency band. The top-load element 40 functions as part of an element for an FM frequency band and a DTV frequency band, and also functions as an element for, for example, an AM frequency band. The top-load element 40 is connected to the coil 50 and the capacitor 71 on a side opposite to a side on which the coil 50 and the capacitor 71 are connected to the first amplifier circuit 25 and the second amplifier circuit 26, respectively. The top-load element 40 can be adjusted to function as a resonance antenna in a desired center frequency different from that on the coil 50 side, that is, the frequency band for DTV by a series circuit of the top-load element 40 and the capacitor 71. The top-load element 40 functions as a capacity-loaded antenna, like the example described above. By obtaining capacitance by the top-load element 40, an element for an FM frequency band and an element for DTV are shortened.

That is, the composite antenna device of the present invention is configured in such a manner that the top-load element 40 is used in common for an element for an FM frequency band and an element for a DIV frequency band, the top-load element 40 is connected to the coil 50 and the capacitor 71 in parallel, and the coil 50 and the capacitor 71 are connected to the first amplifier circuit 25 and the second amplifier circuit 26, respectively. In this case as well, the coil 50 may be disposed on a surface facing the empty area 23 of the circuit board 20 and be disposed axially parallel with the circuit board 20.

By using the capacitor 71, an element length which is too long for a DTV element can be shortened, and an FM frequency band can be prevented from interfering with the DIN element side. A signal of the DTV frequency band does not interfere with the FM frequency band element side where impedance of the coil 50 itself is high. Accordingly, isolation between antenna elements hardly becomes a problem even in the case where a switch like the one in the example shown in FIG. 4 is not provided.

A coil may further be connected in addition to the capacitor 71. That is, the top-load element 40 may be connected to the second amplifier circuit 26 through a series circuit of the capacitor 71 and a coil. In this manner, a function of a filter can be obtained, and other frequency bands can be supported.

The low-profile antenna device according to the present invention is not limited to the above illustrated example. As a matter of course, a variety of changes may be made within a range not deviating from the gist of the present invention.

The invention claimed is:

1. A low-profile antenna device for a vehicle, the low-profile antenna device comprising:

a base plate fixed to a vehicle;

a circuit board disposed on the base plate in parallel with the base plate, the circuit board having a first side and a second side that faces in an opposite direction from the first side, the circuit board provided with an amplifier circuit placed thereon and having a ground plate area with a around plate on the first side of the circuit board and an empty area with no ground plate on the first side of the circuit board;

a top-load element that is spaced apart by a gap in a height direction from the base plate, and functions as a capacity antenna; and a coil disposed on the second side of the circuit board at a position corresponding to the empty area, the coil being disposed axially parallel with the circuit board, being connected between the top-load element and the amplifier circuit on the circuit board, and being adjusted to function as a resonance antenna at a desired center frequency by a series circuit of the top-load element and the coil.

2. The low-profile antenna device according to claim 1, wherein the top-load element is connected to the coil by using a belt-like connection line.

3. The low-profile antenna device according to claim 2, wherein the belt-like connection line extends from a front side of the top-load element.

4. The low-profile antenna device according to claim 2, wherein the belt-like connection line has a shape tapered toward the coil.

5. The low-profile antenna device according to claim 2, wherein the belt-like connection line is formed of the same member as that of the top-load element.

6. The low-profile antenna device according to claim 2, wherein the top-load element includes a planar body having a surface extending in parallel with the base plate.

7. The low-profile antenna device according to claim 6, wherein the top-load element has a planar slope section between the planar body having a surface extending in parallel with the base plate and the belt-like connection line.

8. The low-profile antenna device according to claim 1, wherein the top-load element has an apex section and side sections inclined from both sides of the apex section, which, is formed into a mountain-shape in cross section.

9. The low-profile antenna device according to claim 1, wherein the amplifier circuit of the circuit board includes a plurality of frequency-band-specific amplifier circuits provided in accordance with multiple frequency bands, and the coil includes a plurality of frequency-band-specific coils provided in accordance whir multiple frequency bands, the low-profile antenna device further comprising switches respectively provided between the plurality of frequency-band-specific amplifier circuits and the plurality of frequency-band-specific coils, which are ON/OFF controlled in accordance with a frequency band to be received.

10. The low-profile antenna device according to claim 1, wherein the amplifier circuit of the circuit board includes a plurality of frequency-band-specific amplifier circuits provided in accordance with multiple frequency bands, and the coil is connected to one of the plurality of frequency-band-specific amplifier circuits corresponding to a frequency band to be received, the low-profile antenna device further comprising a capacitor connected between the top-load element and the other of the plurality of frequency-band-specifics amplifier circuits corresponding to a frequency band to be received that is different from that on the coil side, the capacitor being adjusted to function as a resonance antenna at a desired center frequency different from that on the coil side by a series circuit of the top-load element and the capacitor.

* * * * *